US007566052B2

(12) United States Patent
Hsu et al.

(10) Patent No.: US 7,566,052 B2
(45) Date of Patent: Jul. 28, 2009

(54) AUTOMATIC DOCUMENT FEEDER AND ELECTRIC EQUIPMENT HAVING THE SAME

(75) Inventors: Tien-Ho Hsu, Taipei (TW); Hsuan-Yang Lin, Taipei (TW); Chung-Lung Yu, Taipei (TW); Yu-Jen Tsao, Taipei (TW)

(73) Assignee: Lite-On Technology Corp., Taipei (TW)

( * ) Notice: Subject to any disclaimer, the term of this patent is extended or adjusted under 35 U.S.C. 154(b) by 58 days.

(21) Appl. No.: 11/774,758

(22) Filed: Jul. 9, 2007

(65) Prior Publication Data

US 2008/0136084 A1 Jun. 12, 2008

(30) Foreign Application Priority Data

Dec. 8, 2006 (TW) ..... 95145981 A

(51) Int. Cl.
*B65H 3/52* (2006.01)

(52) U.S. Cl. ..... 271/121; 271/110; 271/124; 271/226; 271/245; 271/246

(58) Field of Classification Search ..... 271/245, 271/246, 226, 110, 121, 124
See application file for complete search history.

(56) References Cited

U.S. PATENT DOCUMENTS 4,791,457 A * 12/1988 Shida ..... 399/392
5,289,206 A * 2/1994 Ishikawa et al. ..... 346/134
5,316,285 A * 5/1994 Olson et al. ..... 271/122
5,909,872 A * 6/1999 Takahashi ..... 271/116
6,168,154 B1 * 1/2001 Asahara et al. ..... 271/245
6,199,855 B1 * 3/2001 Choeng et al. ..... 271/122
6,349,931 B1 * 2/2002 Kuo et al. ..... 271/110
6,390,463 B1 * 5/2002 Iwago ..... 271/118
6,598,873 B2 * 7/2003 Takisawa et al. ..... 271/246
6,651,972 B2 * 11/2003 Hsiao et al. ..... 271/114
6,893,013 B2 5/2005 Spitz et al.
7,048,271 B2 * 5/2006 Sheng et al. ..... 271/121
7,255,339 B2 * 8/2007 Hung et al. ..... 271/122
7,410,161 B2 * 8/2008 Yamamoto ..... 271/124
2002/0020960 A1 * 2/2002 Waragai et al. ..... 271/226
2002/0030321 A1 * 3/2002 Sugiyama et al. ..... 271/226
2002/0074711 A1 * 6/2002 Higaki ..... 271/117
2002/0175462 A1 * 11/2002 Sonoda et al. ..... 271/121
2004/0188918 A1 * 9/2004 Morimoto et al. ..... 271/121
2004/0251595 A1 * 12/2004 Sheng et al. ..... 271/121
2007/0080495 A1 * 4/2007 Tu ..... 271/274
2007/0158898 A1 * 7/2007 Hung et al. ..... 271/109
2008/0197560 A1 * 8/2008 Lee et al. ..... 271/121

* cited by examiner

*Primary Examiner*—Patrick H Mackey
*Assistant Examiner*—Prasad V Gokhale
(74) *Attorney, Agent, or Firm*—Rosenberg, Klein & Lee

(57) ABSTRACT

An automatic document feeder for electric equipment includes an input tray, a driving mechanism, and a block mechanism. The input tray has a receiving end, a discharge end, and a first path extending from the receiving end to the discharge end. The driving mechanism includes a separating-roller shaft disposed above the input tray and in proximity to the discharge end, and a separating roller sleeved fixedly on the shaft. The blocking mechanism includes a blocking member pivotable between a blocking position whereat the blocking member is disposed on the first path, and a non-blocking position whereat the blocking member is removed from the first path. A driven arm is connected to and co-rotatable with the separating-roller shaft so as to pivot the blocking member between the blocking position and the non-blocking position.

11 Claims, 7 Drawing Sheets

AUTOMATIC DOCUMENT FEEDER AND ELECTRIC EQUIPMENT HAVING THE SAME

CROSS-REFERENCE TO RELATED APPLICATION

This application claims priority of Taiwanese Application No. 095145981, filed on Dec. 8, 2006.

BACKGROUND OF THE INVENTION

1. Field of the Invention

This invention relates to an automatic document feeder for electric equipment, and more particularly to an automatic document feeder including an improved blocking mechanism.

2. Description of the Related Art

FIGS. 1, 2, and 3 show a conventional automatic document feeder 1 for electric equipment 100, which is disclosed in U.S. Pat. No. 6,893,013. The conventional automatic document feeder 1 includes an input tray 11, a feeding roller unit 12, and a blocking mechanism 13. The feeding roller unit 12 includes a shaft 121, and two feeding rollers 122, 123 sleeved on the shaft 121. 13. A compression spring 131, a C-shaped collar 132, and a driven arm 133 of the blocking mechanism 13 are sleeved on the shaft 121 between the feeding rollers 122, 123. The C-shaped collar 132 has two ends abutting respectively against the feeding roller 123 and the compression spring 131 so as to allow for co-rotation of the driven arm 133 with the shaft 121.

When the shaft 121 is rotated in a counterclockwise direction shown by the arrow in FIG. 1, the driven arm 133 pushes and rotates a first strip portion 135 of a blocking member 134 disposed pivotally on an inner end 111 of the input tray 11 in a clockwise direction. Hence, a second strip portion 136 of the blocking member 134 projects upwardly from the inner end of the input tray 11. That is, the blocking member 134 is disposed in a blocking position. In the blocking position, documents to be scanned can be placed onto the input tray 11 through an outer end 112 of the input tray 11 in such a manner that the leading ends of the documents abut against the second strip portion 136. Subsequently, when it is desired to pick one of the documents up, the shaft 121 is rotated clockwise, as shown in FIG. 2. Hence, the driven arm 133 is removed from the first strip portion 135. As a result, the blocking member 134 rotates by virtue of gravity to cause the second strip portion 136 to abut against a paper dam 14 so as to dispose the blocking member 134 in a non-blocking position, thereby allowing the one of the documents to be fed from the input tray 11.

The aforesaid conventional automatic document feeder 1 has the following disadvantages:

(1) Since the compression spring 131, the collar 132, and the driven arm 133 are sleeved on the shaft 121 between the feeding rollers 122, 123, the conventional automatic document feeder 1 is difficult to assemble.

(2) Since the shaft 121 is disposed under the input tray 11, the above-mentioned members connected to the shaft 121 are difficult to repair.

(3) The driven arm 133 occupies a large amount of space under the input tray 11. Thus, the length of a path for transferring the documents in the conventional automatic document feeder 1 is increased. As a result, the blocking mechanism 13 is not suitable for duplex document feeders.

SUMMARY OF THE INVENTION

The object of this invention is to provide an automatic document feeder that can overcome the above-mentioned disadvantages associated with the prior art.

According to an aspect of this invention, an automatic document feeder for electric equipment comprises:

an input tray having a receiving end, a discharge end, and a first path extending from the receiving end to the discharge end;

a driving mechanism including a separating-roller shaft disposed above the input tray and in proximity to the discharge end, and a separating roller sleeved fixedly on the shaft; and a blocking mechanism including a blocking member disposed in proximity to the discharge end of the input tray, the blocking member being pivotable relative to the input tray between a blocking position whereat the blocking member is disposed on the first path, and a non-blocking position whereat the blocking member is removed from the first path, and a driven arm connected to and co-rotatable with the separating-roller shaft so as to pivot the blocking member between the blocking position and the non-blocking position.

Since the driven arm is connected to the separating-roller shaft, the blocking mechanism can be assembled and replaced with ease. Furthermore, the space located in the automatic document feeder under the input tray and occupied by the blocking mechanism is reduced.

According to another aspect of this invention, electric equipment comprises:

a base; and an automatic document feeder disposed on the base and including an input tray having a receiving end, a discharge end, and a first path extending from the receiving end to the discharge end, a driving mechanism including a separating-roller shaft disposed above the input tray and in proximity to the discharge end, and a separating roller sleeved fixedly on the shaft, and a blocking mechanism including a blocking member and a driven arm, the blocking member being disposed in proximity to the discharge end of the input tray, the blocking member being pivotable relative to the input tray between a blocking position whereat the blocking member is disposed on the first path, and a non-blocking position where at the blocking member is removed from the first path, the driven arm being connected to and co-rotatable with the separating-roller shaft so as to pivot the blocking member between the blocking position and the non-blocking position.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
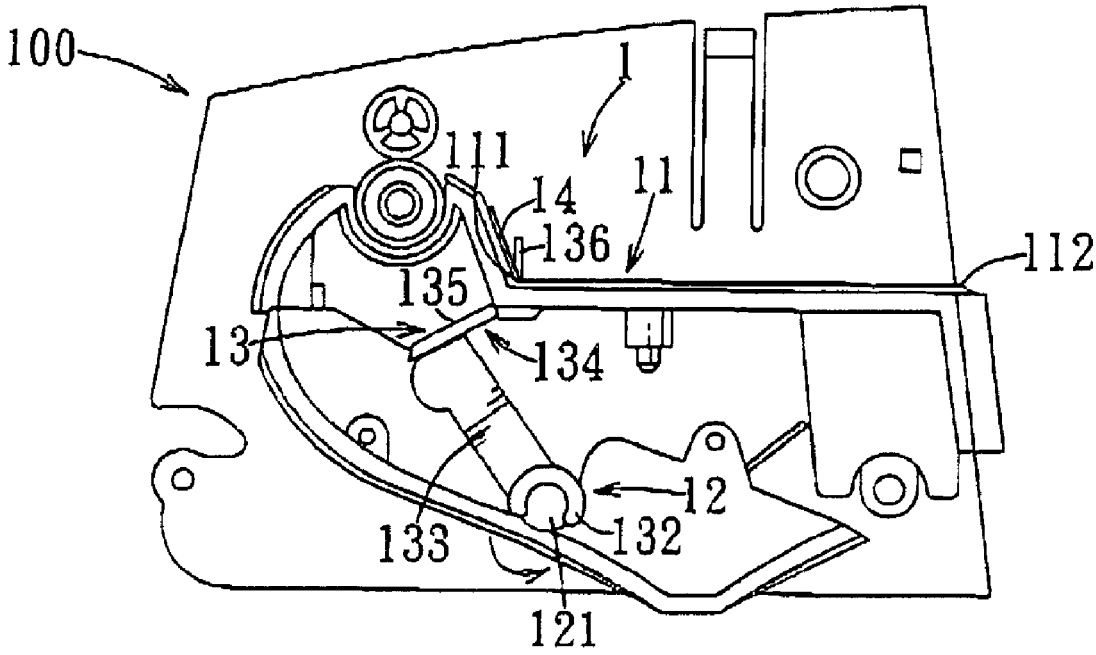
FIG. 1 PRIOR ART
FIG. 1 is a schematic side view of a conventional automatic document feeder disclosed in U.S. Pat. No. 6,893,013 when a blocking member is disposed in a blocking position.
Figure 2:
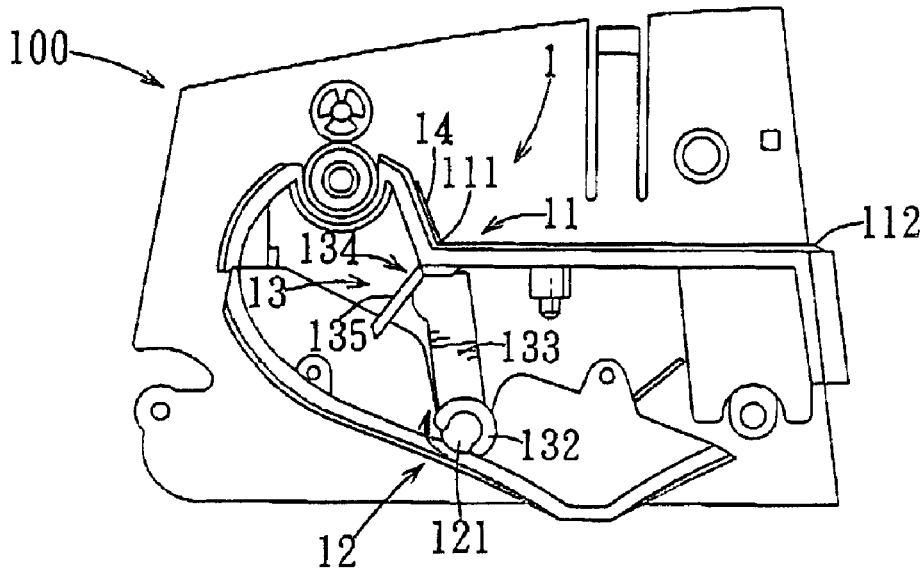
FIG. 2 PRIOR ART
FIG. 2 is a view similar to FIG. 1 when the blocking member is in a non-blocking position.
Figure 3:
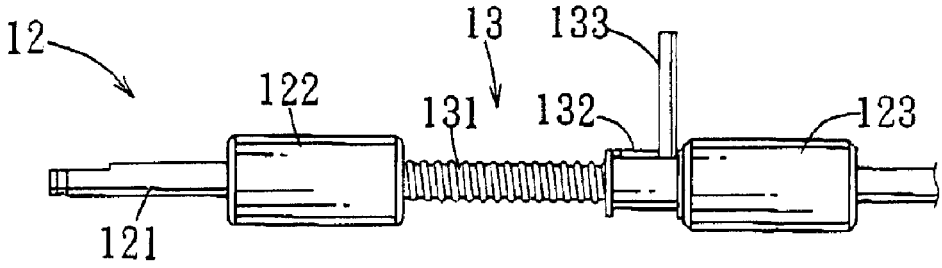
FIG. 3 PRIOR ART
FIG. 3 is a top view of a feeding roller unit and a blocking mechanism of the conventional automatic document feeder.

Before the present invention is described in greater detail in connection with the preferred embodiments, it should be noted that similar elements and structures are designated by like reference numerals throughout the entire disclosure.

Figure 4:
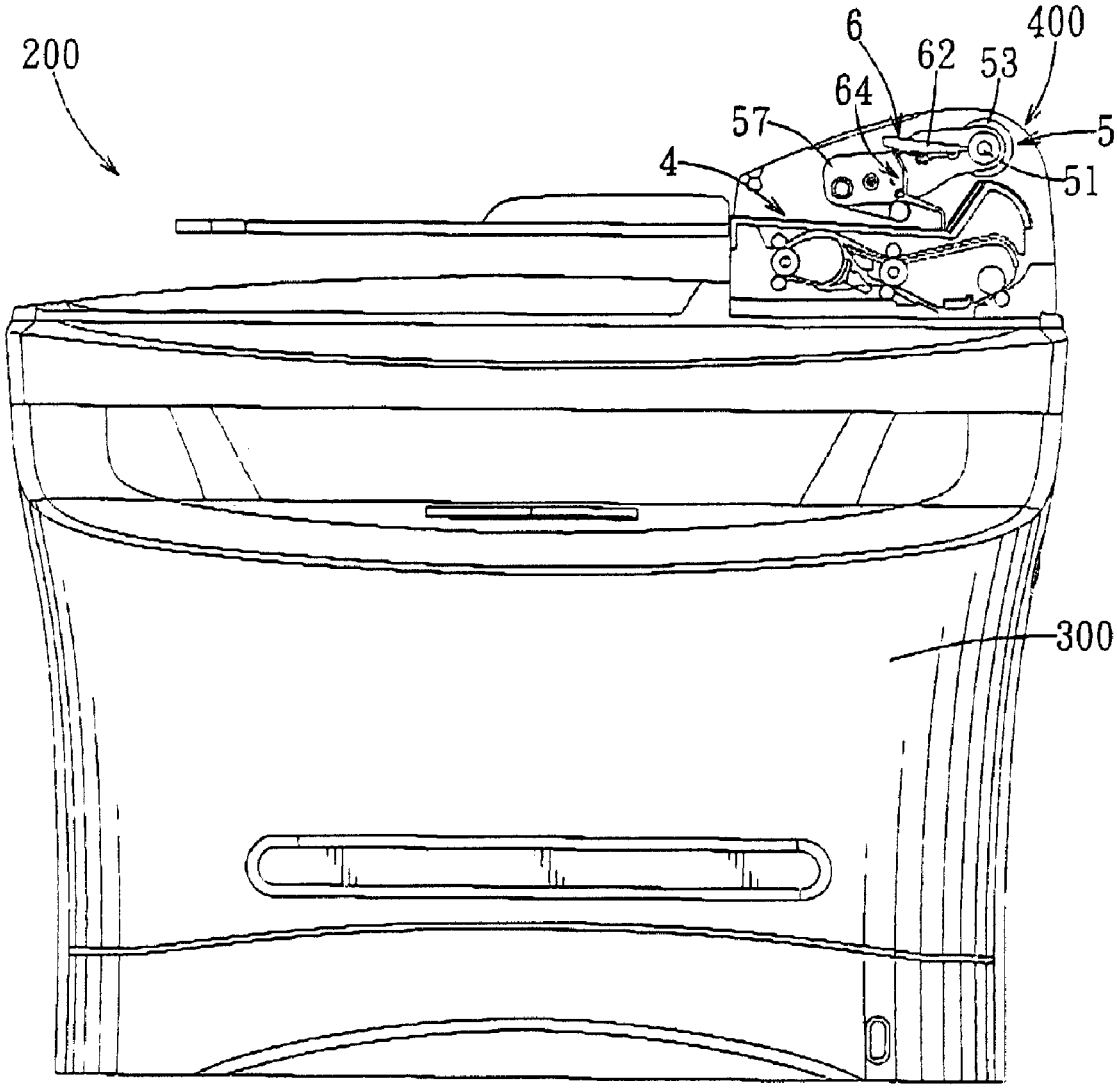
FIG. 4 is a schematic side view of the first preferred embodiment of an automatic document feeder according to this invention, which is mounted on electric equipment.
Figure 5:
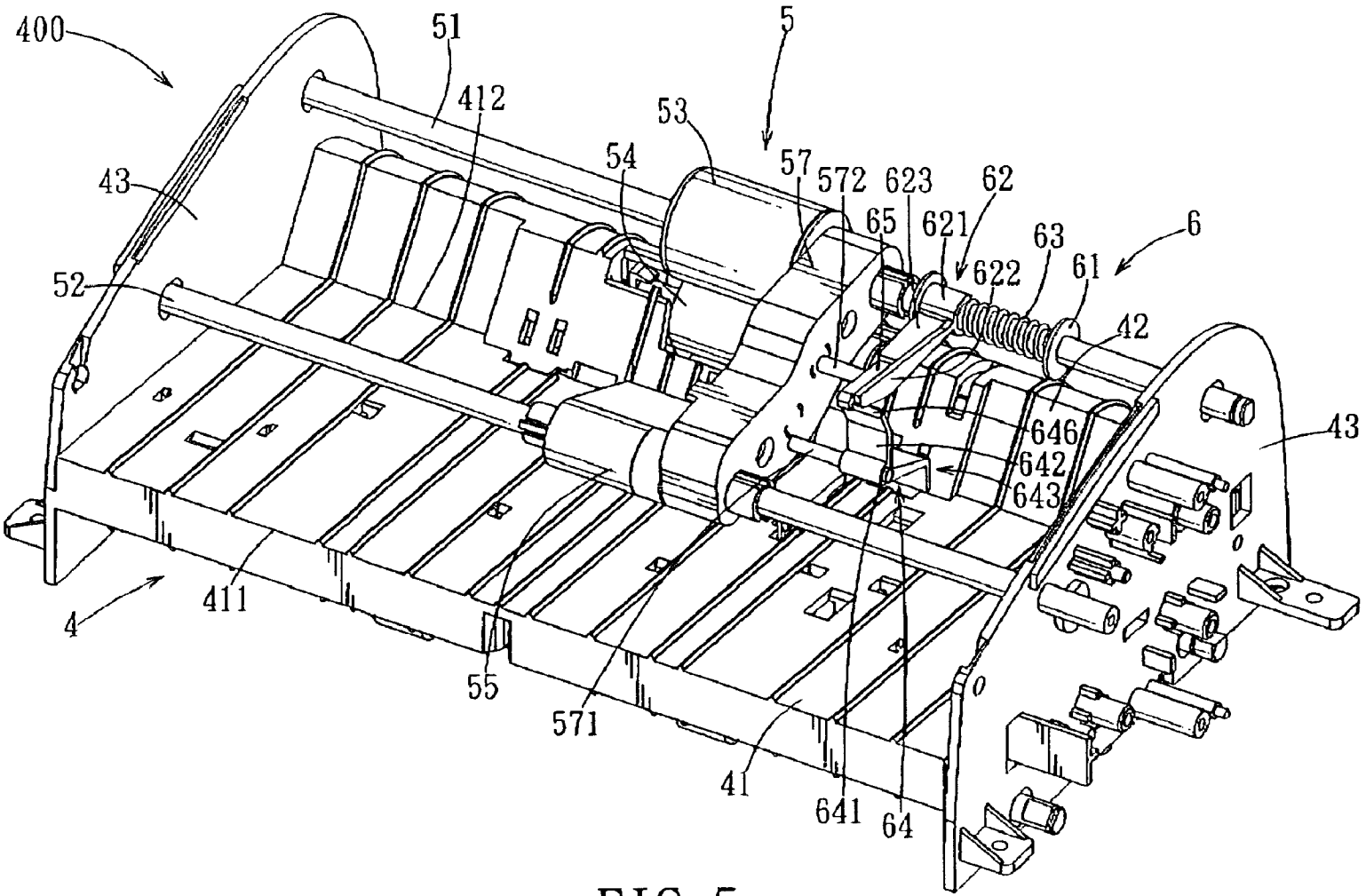
FIG. 5 is a perspective view of the first preferred embodiment.

Referring to FIG. 4, the first preferred embodiment of an automatic document feeder 400 is suitable for electric equipment 200. In this embodiment, the electric equipment 200 is configured as a copier having a two-sided scanning function, and includes a base 300. The base 300 includes a scanning device (not shown) disposed at a bottom end portion thereof, and a copying device (not shown) disposed under the scanning device. The automatic document feeder 400 is disposed on and above the base 300. Alternatively, the electric equipment 200 may be a telefax machine or a scanner.

Referring to FIGS. 4, 5, 6, and 7, the automatic document feeder 400 includes an input tray 4 disposed on a top surface of the base 300, as well as a driving mechanism 5 and a blocking mechanism 6 that are disposed on the input tray 4. The input tray 4 includes a receiving end 411, a discharge end 412 opposite to and disposed behind the receiving end 411, and a first path (I) extending from the receiving end 411 to the discharge end 412. The input tray 4 further includes a tray body 41 defining the receiving end 411 and the discharge end 412 and permitting documents 40 to be placed thereon, and a paper dam 42 disposed at the discharge end 412 and extending upwardly from the tray body 41.

The automatic document feeder 400 further includes a second path (II) and a third path (III). The second path (II) is disposed under the input tray 4, and has an inlet end 201 disposed under and in spatial communication with the discharge end 412 of the input tray 4, and an outlet end 202 disposed in proximity to the receiving end 411 of the input tray 4. The third path (III) is disposed under the first path (I) and above the second path (II), and has an inlet end 301 in spatial communication with the outlet end 202 of the second path (II), and an outlet end 302 in spatial communication with an intermediate portion of the second path (II) at a position under the discharge end 412 of the input tray 4. The third path (III) cooperates with the first and second paths (I, II) so as to constitute a document path allowing one of the documents 40 to be moved therealong.

The driving mechanism 5 includes a separating-roller shaft 51 disposed directly above the paper dam 42 between two side plates 43, a pivot shaft 52 disposed in front of the separating-roller shaft 51, and a separating roller 53 sleeved fixedly on the separating-roller shaft 51. A follower roller 54 is disposed pivotally on the paper dam 42, and is aligned with the separating roller 53. A swing arm 55 is sleeved on the pivot shaft 52, and is provided with a pickup roller 56 at a free end thereof for moving one of the documents 40 along the first path (I). The driving mechanism 5 further includes a housing 57 attached to the separating-roller shaft 51 and the pivot shaft 52 and disposed in proximity to and located at the right side of the separating roller 53 and the swing arm 55. The housing 57 is formed with integral first and second pivot pins 571, 572. A gear unit (not shown) is disposed within the housing 57 and the swing arm 55 for transferring rotation from the separating roller 53 to the pickup roller 56. The separating roller 53 cooperates with the follower roller 54 so as to allow only one of the documents 40 to pass therethrough.

The blocking mechanism 6 is disposed in proximity to the discharge end 412 of the input tray 4, and includes two washers 61 sleeved fixedly on the separating-roller shaft 51 and located at the right side of the housing 57, as well as a driven arm 62 and a resilient member 63 that are sleeved on the separating-roller shaft 51 between the washers 61. The resilient member 63 is configured as a coiled compression spring. Alternatively, the resilient member 63 may be configured as a disc spring. The driven arm 62 has a pivot portion 621, a first arm portion 622, and a second arm portion 623. The pivot portion 621 is sleeved on the separating-roller shaft 51, and has two ends abutting respectively against the resilient member 63 and one of the washers 61. The resilient member 63 presses the driven arm 62 against the one of the washers 61 so as to allow co-rotation of the driven arm 62 with the separating-roller shaft 51. The first and second arm portions 622, 623 are connected integrally to and pivotable about the pivot portion 621, and are spaced apart from each other along an axial direction of the separating-roller shaft 51. The first arm portion 622 is longer than the second arm portion 623.

The blocking member 6 further includes a blocking member 64 and a position-limiting member 65 that are disposed pivotally on the housing 57 and that are located at the right side of the housing 57. The first pivot pin 571 of the housing 57 extends through a first pivot hole 641 in the blocking member 64. The blocking member 64 includes a pair of first and second strip portions 642, 643. The second strip portion 643 is heavier than the first strip portion 642. The second strip portion 643 has an inner strip section 644 and an outer strip section 645 that form an angle therebetween. The first strip portion 642 has an inner strip section 646 and an outer strip section 647 that form an angle therebetween. The inner strip sections 644, 646 are interconnected integrally, and form an angle therebetween. The outer strip sections 645, 647 extend respectively from outer ends of the inner strip sections 644, 646. The blocking member 64 is pivotable relative to the input tray 4 between a blocking position shown in FIG. 6 and a non-blocking position shown in FIG. 7. In the blocking position, the outer strip section 645 is vertical, and is disposed on the first path (I). In the non-blocking position, the blocking member 64 is removed from the first path (I). The position-limiting member 65 has a rod portion 651 formed with a second pivot hole 652 at a middle portion thereof. The second pivot pin 572 of the housing 57 extends through the second pivot hole 652 in the middle portion of the position-limiting member 65. The position-limiting member 65 further includes a retaining hook 653 connected integrally to the left end of the rod portion 651. When the blocking member 64 is disposed in the blocking position, the second arm portion 623 of the driven arm 62 is spaced apart from the right end of the rod portion 651, and the retaining hook 653 engages an outer end of the outer strip section 647 of the first strip portion 642 so as to maintain the blocking member 64 in the blocking position. When the blocking member 64 is disposed in the non-blocking position, the second arm portion 623 of the driven arm 62 presses against the right end of the rod portion 651 so as to remove the retaining hook 653 from the blocking member 64, thereby releasing the blocking member 64 from the retaining hook 653. Also in the non-blocking position, an engaging surface 624 of the first arm portion 622 presses against the inner strip section 646 of the first strip portion 642 so as to maintain the blocking member 64 in the non-blocking position.

Figure 6:
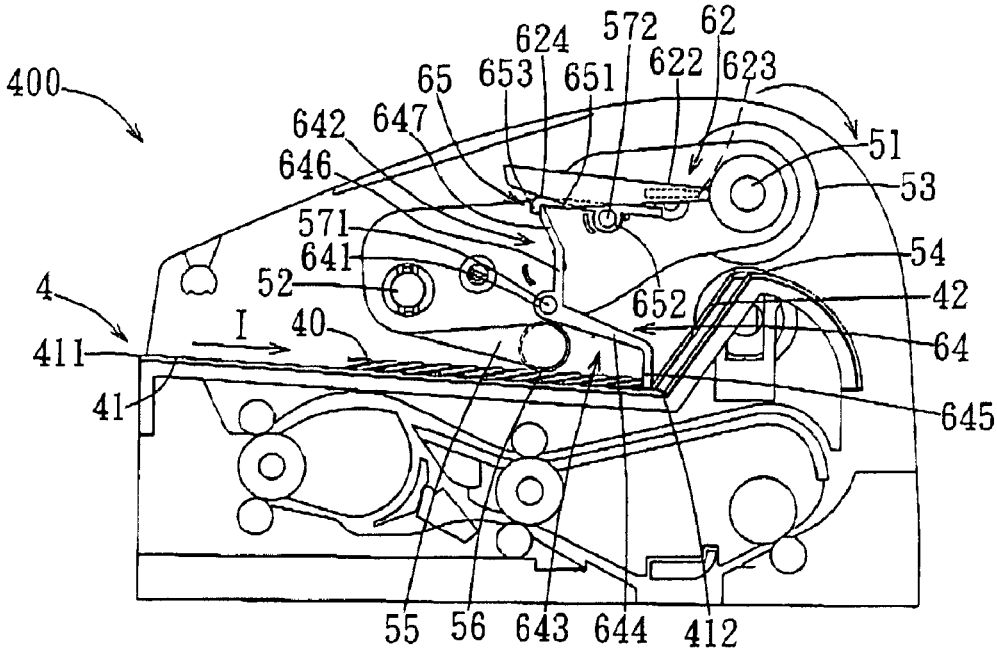
FIG. 6 is a schematic side view of the first preferred embodiment when a blocking member is disposed in a blocking position.

In the case where the blocking member 64 is in the non-blocking position, upon actuation of the electric equipment 200, if a sensor (not shown) detects an absence of the documents 40 from the input tray 4, it will emit a corresponding signal to a controller (not shown). When the controller receives the signal, it drives the separating-roller shaft 51 and, thus, the driven arm 62 to rotate clockwise by a small angle, as shown in FIG. 6. Clockwise rotation of the driven arm 62 results in release of the blocking member 64 and the position-limiting member 65 from the driven arm 62 (i.e., separation of the engaging surface 624 and the second arm portion 623 from the inner strip portion 646 and the right end of the rod portion 651, respectively). Hence, the blocking member 64 pivots to the blocking position due to gravity, and the left end of the rod portion 651 pivots downwardly due to gravity to thereby engage the retaining hook 653 with the outer end of the first strip portion 642 of the blocking member 64.

Figure 7:
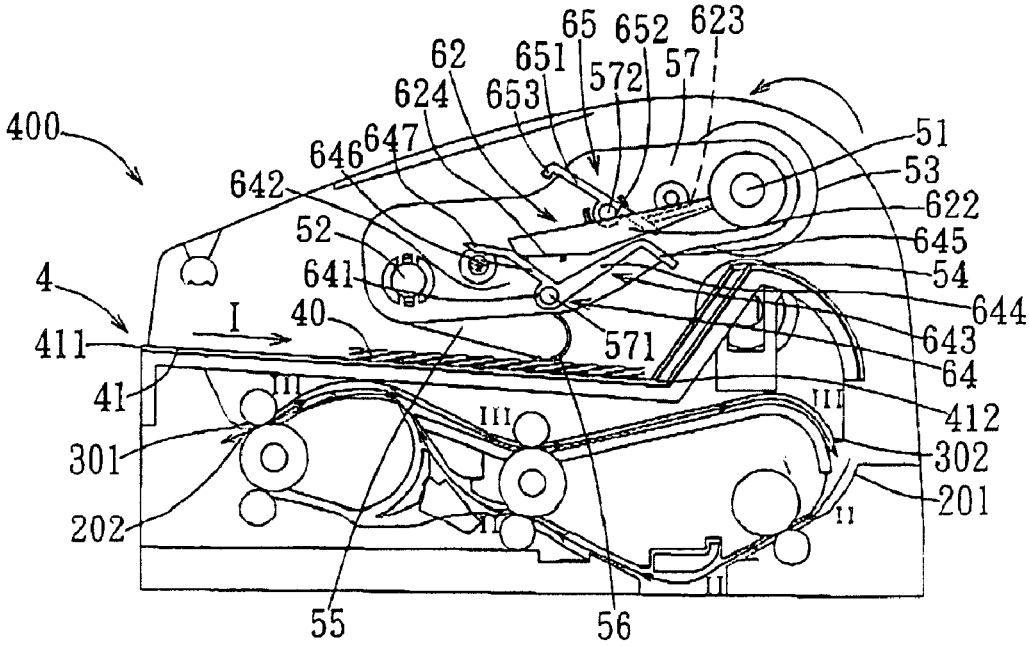
FIG. 7 is a view similar to FIG. 6 when the blocking member is disposed in a non-blocking position.

In the case where the blocking member 64 is in the blocking position, upon actuation of the electric equipment 200, if the sensor detects the presence of the documents 40 on the input tray 4, it will emit a corresponding signal to the controller. When the controller receives the signal, it drives the separating-roller shaft 51 and, thus, the driven arm 62 to rotate counterclockwise by a small angle, as shown in FIG. 7. During counterclockwise rotation of the driven arm 62, the second arm portion 623 contacts and rotates the right end of the rod portion 651 clockwise so as to remove the retaining hook 653 from the end of the first strip portion 642 of the blocking member 64, and subsequently, the engaging surface 624 of the first arm portion 622 contacts and rotates the first strip portion 642 counterclockwise. Hence, the blocking member 64 is moved to the non-blocking position. In the non-blocking position, since the blocking member 64 is not disposed on the first path (I), the pickup roller 56 can move the uppermost document 40 rearwardly through the separating roller 53. Thereafter, the uppermost document 40 is moved forwardly along the second path (II) for first-side scanning, and rearwardly along the third path (III) for second-side scanning.

Since the driven arm 62 is connected to the separating-roller shaft 51, and is disposed above the input tray 4, it can be easily assembled and repaired. Furthermore, the total length of the first, second, and third paths (I, II, III) is short. Thus, the object of this invention is achieved.

Figure 8:
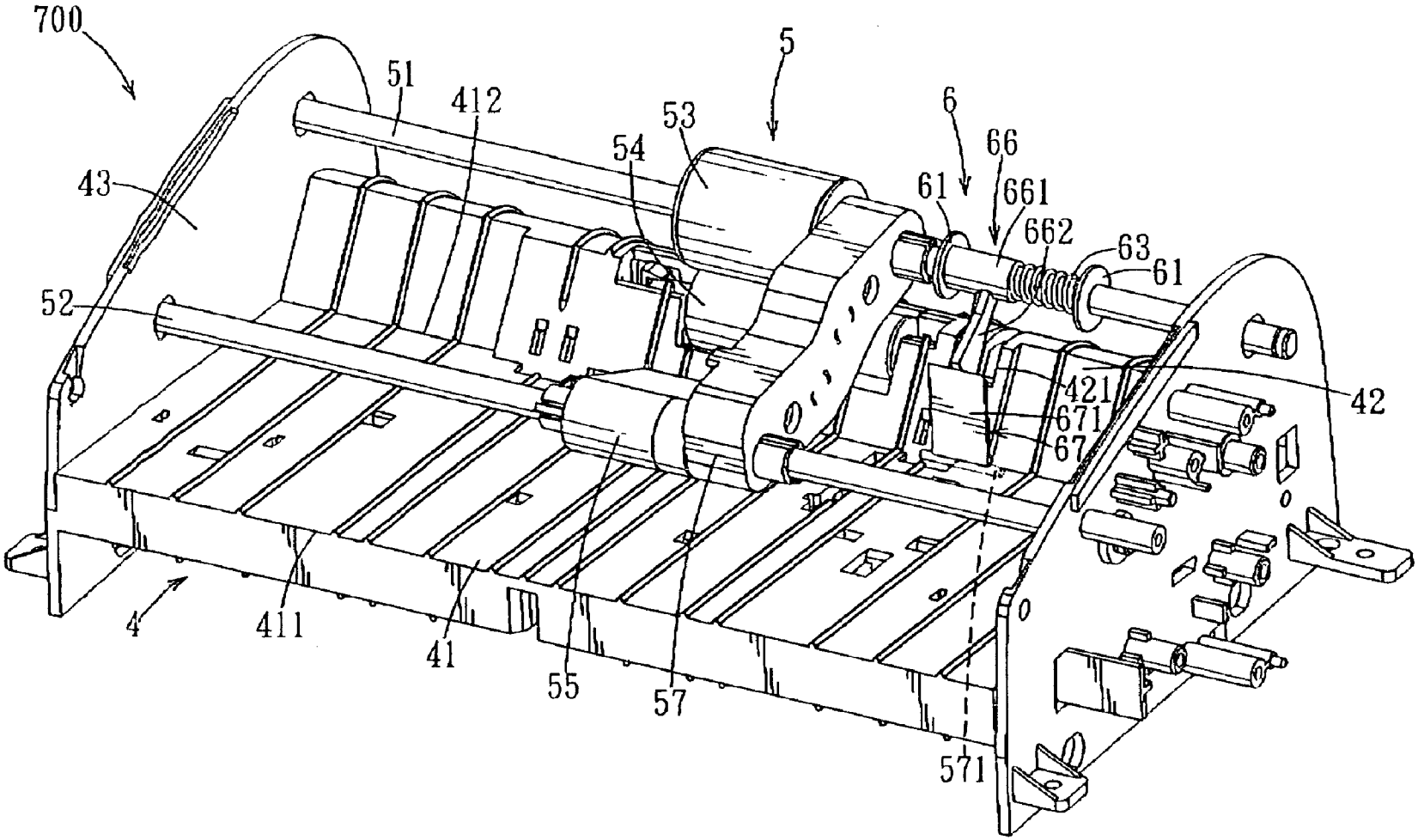
FIG. 8 is a perspective view of the second preferred embodiment.
Figure 9:
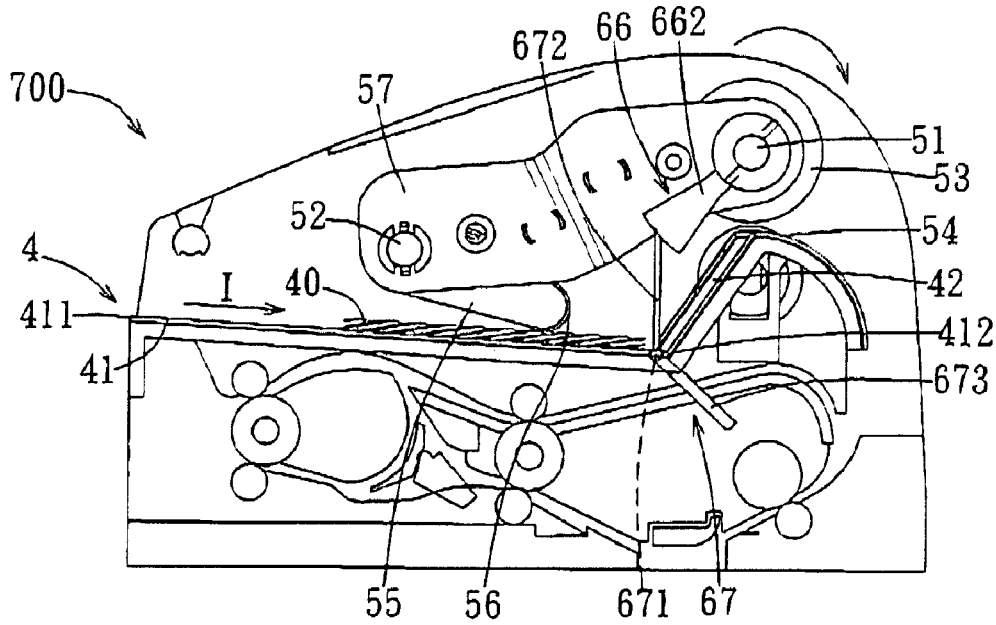
FIG. 9 is a schematic side view of the second preferred embodiment when a blocking member is disposed in a blocking position.
Figure 10:
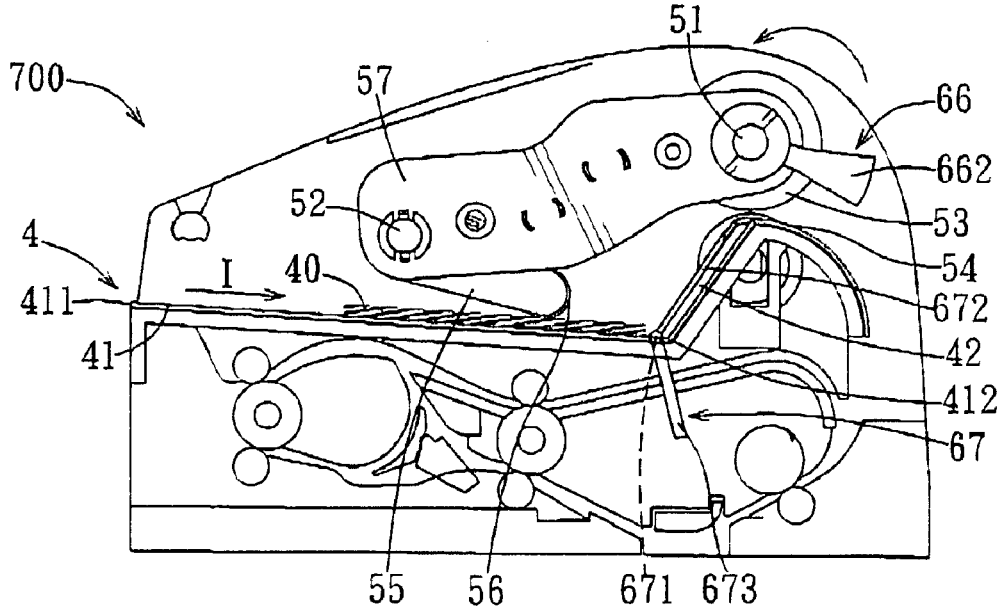
FIG. 10 is a view similar to FIG. 9 when the blocking member is disposed in a non-blocking position.

FIGS. 8, 9, 10 show the second preferred embodiment of an automatic document feeder 700 for electric equipment (not shown) according to this invention, which includes a modified blocking mechanism 6.

The modified blocking mechanism 6 includes a driven arm 66 and a blocking member 67. The driven arm 66 has a pivot portion 661 sleeved movably on the separating-roller shaft 51, and an arm portion 662 connected integrally to and pivotable about the pivot portion 661. The blocking member 67 has a pivot shaft portion 671 disposed pivotally on the input tray 4 and in proximity to the discharge end 412 of the input tray 4, a first strip portion 672 extending radially from the pivot shaft portion 671, and a second strip portion 673 extending radially from the pivot shaft 671 away from the first strip portion 672 and disposed under the first strip portion 672. The first and second strip portions 672, 673 form an angle therebetween. The second strip portion 673 is heavier than the first strip portion 672. The blocking member 67 is pivotable relative to the input tray 4 between a blocking position shown in FIG. 9 and a non-blocking position shown in FIG. 10. In the blocking position, the first strip portion 672 is vertical, abuts against the arm portion 662 of the driven arm 66 at an upper end thereof, and is disposed on the first path (I), and the second strip portion 673 is inclined. In the non-blocking position, the first strip portion 672 is removed from the first path (I), and abuts against the paper dam 42, and the second strip portion 673 is pivoted downwardly. In this embodiment, the paper dam 42 has a top surface formed with a recess 421 that allows for passage of the arm portion 662 of the drive arm 66.

In the case where the blocking member 67 is in the non-blocking position, upon actuation of the electric equipment, if the sensor detects an absence of the documents 40 from the input tray 4, it emits a corresponding signal to the controller. When the controller receives the signal, it drives the separating-roller shaft 51 and, thus, the driven arm 66 to rotate clockwise by a small angle, as shown in FIG. 9. Hence, the arm portion 662 of the driven arm 66 pushes the first strip portion 672 to a vertical position shown in FIG. 9 so as to dispose the blocking member 67 in the blocking position.

In the case where the blocking member 67 is in the blocking position, upon actuation of the electric equipment, if the sensor detects the presence of the documents 40 on the input tray 4, it emits a corresponding signal to the controller. When the controller receives the signal, it drives the separating-roller shaft 51 and, thus, the driven arm 66 to rotate counterclockwise by a small angle, as shown in FIG. 10 so as to separate from the first strip portion 672. Hence, the second strip portion 673 pivots downwardly since it is heavier than the first strip portion 672, as described above. Thus, the first strip portion 672 comes into contact with the paper dam 42 so as to dispose the blocking member 67 in the non-blocking position.

With this invention thus explained, it is apparent that numerous modifications and variations can be made without departing from the scope and spirit of this invention. It is therefore intended that this invention be limited only as indicated by the appended claims.

We claim:

1. An automatic document feeder for electric equipment, said automatic document feeder comprising:

an input tray having a receiving end, a discharge end, and a first path extending from said receiving end to said discharge end;

a driving mechanism including a separating-roller shaft disposed above said input tray and in proximity to said discharge end, and a separating roller sleeved fixedly on said separating-roller shaft; and a blocking mechanism including a blocking member disposed in proximity to said discharge end of said input tray, said blocking member being pivotable relative to said input tray between a blocking position whereat said blocking member is disposed on said first path, and a non-blocking position whereat said blocking member is removed from said first path, and a driven arm connected to and co-rotatable with said separating-roller shaft so as to pivot said blocking member between said blocking position and said non-blocking position;

wherein said driving mechanism includes a housing attached to said separating-roller shaft and disposed in proximity to said driven arm, said blocking member being connected pivotally to said housing and having a first strip portion abutting against said driven arm when said blocking member is disposed in said blocking position, and a second strip portion being disposed on said first path when said blocking member is disposed in said blocking position, said housing being formed with an integral first pivot pin, said first strip portion of said blocking member being formed with a first pivot hole, and said first pivot pin extending through said first pivot hole in said first strip portion.

2. The automatic document feeder as claimed in claim 1, wherein said housing is further formed with an integral second pivot pin, said blocking mechanism further includes a position-limiting member connected pivotally to said housing and having a rod portion, said rod portion of said position-limiting member having a middle portion formed with a second pivot hole, said second pivot pin extending through said second pivot hole in said middle portion of said rod portion.

3. The automatic document feeder as claimed in claim 1, wherein said blocking mechanism further includes a position-limiting member connected pivotally to said housing, said position-limiting member including a retaining hook engaging an end of said first strip portion of said blocking member when said blocking member is disposed in said blocking position.

4. The automatic document feeder as claimed in claim 3, wherein said driven arm has a pivot portion sleeved on said separating-roller shaft, and a first arm portion formed with an engaging surface that abuts against said first strip portion when said blocking member is disposed in said non-blocking position.

5. The automatic document feeder as claimed in claim 4, wherein said position-limiting member has a rod portion, said retaining hook being connected integrally to an end of said rod portion, said driven arm further having a second arm portion connected to said pivot portion such that, when said blocking member is disposed in said blocking position, said driven arm is rotatable in a direction so as to push and rotate said position-limiting member in an opposite direction, thereby removing said retaining hook from said end of said first strip portion of said blocking member.

6. The automatic document feeder as claimed in claim 4, wherein said first strip portion has an inner strip section and an outer strip section that forms an angle therebetween, said inner strip section having an outer end, said outer strip section extending outwardly from said outer end of said inner strip section and having an outer end that engages said retaining hook when said blocking member is disposed in said blocking position.

7. The automatic document feeder as claimed in claim 1, further comprising:

a second path disposed under said input tray and having an inlet end disposed under and in spatial communication with said discharge end of said input tray, and an outlet end disposed in proximity to said receiving end of said input tray; and a third path disposed under said first path and above said second path and having an inlet end in spatial communication with said outlet end of said second path, and an outlet end in spatial communication with an intermediate portion of said second path at a position under said discharge end of said input tray, said third path cooperating with said first and second paths so as to constitute a document path adapted to allow a document to be moved therealong.

8. An automatic document feeder for electric equipment, said automatic document feeder comprising:

an input tray having a receiving end, a discharge end, and a first path extending from said receiving end to said discharge end;

a driving mechanism including a separating-roller shaft disposed above said input tray and in proximity to said discharge end, and a separating roller sleeved fixedly on said separating-roller shaft; and a blocking mechanism including a blocking member disposed in proximity to said discharge end of said input tray, said blocking member being pivotable relative to said input tray between a blocking position whereat said blocking member is disposed on said first path, and a non-blocking position whereat said blocking member is removed from said first path, and a driven arm connected to and co-rotatable with said separating-roller shaft so as to pivot said blocking member between said blocking position and said non-blocking position, said driven arm having a pivot portion sleeved on said separating-roller shaft, and an arm portion pivotable about said pivot portion, said blocking member having a first strip portion abutting against said arm portion of said driven arm when said blocking member is disposed in said blocking position, said first strip portion being removed from said arm portion of said driven arm when said blocking member is disposed in said non-blocking position;

wherein said input tray includes a tray body defining said inlet and discharge ends, and a paper dam extending upwardly from said tray body and disposed at said discharge end, said paper dam having a top surface formed with a recess that allows for passage of said arm portion of said driven arm therethrough, said first strip portion abutting against said paper dam when said blocking member is disposed in said non-blocking position.

9. Electric equipment comprising:

a base; and an automatic document feeder disposed on said base and including an input tray having a receiving end, a discharge end, and a first path extending from said receiving end to said discharge end, a driving mechanism including a separating-roller shaft disposed above said input tray and in proximity to said discharge end, and a separating roller sleeved fixedly on said separating-roller shaft, and a blocking mechanism including a blocking member and a driven arm, said blocking member being disposed in proximity to said discharge end of said input tray, said blocking member being pivotable relative to said input tray between a blocking position whereat said blocking member is disposed on said first path, and a non-blocking position whereat said blocking member is removed from said first path, said driven arm being connected to and co-rotatable with said separating-roller shaft so as to pivot said blocking member between said blocking position and said non-blocking position, said driven arm having a pivot portion sleeved on said separating-roller shaft, and an arm portion pivotable about said pivot portion, said blocking member having a first strip portion abutting against said arm portion of said driven arm when said blocking member is disposed in said blocking position, said blocking member further having a pivot shaft portion disposed pivotally on said input tray and in proximity to said discharge end, said first strip portion extending radially from said pivot shaft portion, said blocking member further having a second strip portion extending radially from said pivot shaft portion away from said first strip portion, said first and second strip portions forming an angle therebetween, said second strip portion being disposed on said first path when said blocking member is disposed in said blocking position, said second strip portion being removed from said first path when said blocking member is disposed in said non-blocking position, said blocking mechanism further including a position-limiting member connected pivotally to said housing, said position-limiting member includes a retaining hook engaging an end of said first strip portion of said blocking member when said blocking member is disposed in said blocking position.

10. The electric equipment as claimed in claim 9, wherein said driven arm has a pivot portion sleeved on said separating-roller shaft, a first arm portion, and said second arm portion, said first and second arm portions being pivotable about said pivot portion, said first arm portion abutting against said first strip portion when said blocking member is disposed in said non-blocking position, said position-limiting member having a rod portion, said retaining hook being connected integrally to an end of said rod portion, said second arm portion being connected to said pivot portion such that, when said blocking member is disposed in said blocking position, said driven arm is rotatable in a direction so as to push and rotate said position-limiting member in an opposite direction, thereby removing said retaining hook from said end of said first strip portion of said blocking member.

11. The electric equipment as claimed in claim 9, wherein said automatic document feeder further includes:

a second path disposed under said input tray and having an inlet end disposed under and in spatial communication with said discharge end of said input tray, and an outlet end disposed in proximity to said receiving end of said input tray; and a third path disposed under said first path and above said second path and having an inlet end in spatial communication with said outlet end of said second path, and an outlet end in spatial communication with an intermediate portion of said second path at a position under said discharge end of said input tray, said third path cooperating with said first and second paths so as to constitute a document path adapted to allow a document to be moved therealong.

* * * * *